US012577857B2

(12) United States Patent
Batita et al.

(10) Patent No.: US 12,577,857 B2
(45) Date of Patent: Mar. 17, 2026

(54) SINGLE TRIP COMPLETION SYSTEM WITH OPEN HOLE GRAVEL PACK GO/STOP PUMPING

(71) Applicant: Schlumberger Technology Corporation, Sugar Land, TX (US)

(72) Inventors: Nabil Ben Mohamed Batita, Houston, TX (US); Balkrishna Gadiyar, Katy, TX (US); Joel Gil, Rosharon, TX (US); Jeremie Poizat, Houston, TX (US); Maye Ezekiel Beldongar, Brookshire, TX (US); Troy Bradley, Houston, TX (US); Olutayo Dada, Houston, TX (US)

(73) Assignee: Schlumberger Technology Corporatio, Sugar Land, TX (US)

( * ) Notice: Subject to any disclaimer, the term of this patent is extended or adjusted under 35 U.S.C. 154(b) by 0 days.

(21) Appl. No.: 18/903,689

(22) Filed: Oct. 1, 2024

(65) Prior Publication Data

US 2025/0020044 A1 Jan. 16, 2025

Related U.S. Application Data

(62) Division of application No. 18/044,387, filed as application No. PCT/US2021/049396 on Sep. 8, 2021, now Pat. No. 12,123,285.

(60) Provisional application No. 63/075,772, filed on Sep. 8, 2020.

(51) Int. Cl.
*E21B 43/04* (2006.01)
*E21B 33/12* (2006.01)
*E21B 34/06* (2006.01)
*E21B 43/08* (2006.01)

(52) U.S. Cl.
CPC ..... *E21B 43/04* (2013.01); *E21B 34/06* (2013.01); *E21B 43/045* (2013.01); *E21B 43/08* (2013.01); *E21B 33/12* (2013.01); *E21B 2200/05* (2020.05)

(58) Field of Classification Search
CPC ..... E21B 43/04; E21B 43/045; E21B 34/06; E21B 43/08
See application file for complete search history.

(56) References Cited

U.S. PATENT DOCUMENTS 4,635,716 A * 1/1987 Zunkel ..... E21B 33/1292 166/131

* cited by examiner

*Primary Examiner* — Robert E Fuller
(74) *Attorney, Agent, or Firm* — Jeffrey D. Frantz

(57) ABSTRACT

A method of completing a well in a single trip includes drilling a wellbore with drilling mud, running a single trip completion string including an upper completion, a lower completion, and a packer between the upper and lower completions into the wellbore, displacing the wellbore to solids free fluid by opening or closing a circulation sliding sleeve disposed below the packer in the lower completion, opening the circulation sliding sleeve and spotting gravel slurry in a casing annulus, closing the circulation sliding sleeve and pumping the gravel slurry down the casing annulus into an open hole annulus while taking returns through a base pipe of a sand control assembly and production tubing of the single trip completion string, opening the circulation sliding sleeve, displacing the cased hole section to completion fluid, closing the circulation sliding sleeve, and setting the packer.

7 Claims, 22 Drawing Sheets

SINGLE TRIP COMPLETION SYSTEM WITH OPEN HOLE GRAVEL PACK GO/STOP PUMPING

CROSS REFERENCE TO RELATED APPLICATIONS

The present application is a divisional of U.S. patent application Ser. No. 18/044,387, filed Mar. 8, 2023, which claims priority to the National Stage of International Application No. PCT/US2021/049396, filed Sep. 8, 2021, which claims priority benefit of U.S. Provisional Application No. 63/075,772, filed Sep. 8, 2020, the entirety of which is incorporated by reference herein and should be considered part of this specification.

BACKGROUND

Subterranean hydrocarbon services are often necessary to produce hydrocarbons from a subterranean formation. Such services can include, without limitation, perforating operations, completion operations, gravel pack operations, frac pack operations, clean-up operations, flow-back operations, treatment operations, testing operations, production operations, injection operations, and monitor and control operations. Each service is typically performed by running specially designed, service-specific equipment, such as a service tool, into and out of the wellbore, and multiple trips for completing the wellbore may be required prior to performing the service operation. This is problematic because each trip into and out of the wellbore increases operational risks, rig time, and personnel hours. Moreover, the service-specific equipment restricts the inner diameter of the tubing available for the service operations. There is a need, therefore, for single trip completion systems and methods for service operations that eliminate the need for service-specific equipment, such as a service tool.

SUMMARY

A method of completing a well in a single trip according to one or more embodiments of the present disclosure includes drilling a wellbore with a water-based or oil-based drilling mud, the wellbore including a cased hole section, and an open hole section. The method further includes running a single trip completion string into the wellbore, the single trip completion string including: an upper completion, a lower completion below the upper completion, and a packer disposed between the upper and lower completions; displacing the wellbore to solids free fluid by opening or closing a circulation sliding sleeve disposed below the packer in the lower completion; opening the circulation sliding sleeve and spotting gravel slurry in a casing annulus, closing the circulation sliding sleeve and pumping the gravel slurry down the casing annulus into an open hole annulus while taking returns through a base pipe of a sand control assembly and production tubing of the single trip completion string, opening the circulation sliding sleeve, displacing the cased hole section to completion fluid, closing the circulation sliding sleeve, and setting the packer.

A method of completing a well in a single trip according to one or more embodiments of the present disclosure includes drilling a wellbore with a water-based or oil-based drilling mud, the wellbore including a cased hole section, and an open hole section. The method further includes running a single trip completion string into the wellbore, the single trip completion string including: an upper completion, a lower completion below the upper completion, and a packer disposed between the upper and lower completions; spotting and pumping high solids content gravel pack fluid (HSCGPF) in conjunction with at least one mechanical plug down tubing and a base pipe of a sand control assembly of the single trip completion string into the open hole section, retaining the at least one mechanical plug in a washdown shoe assembly of the single trip completion string, thereby providing an isolation barrier; opening a circulation sliding sleeve disposed below the packer in the lower completion; displacing the cased hole section to completion fluid; closing the circulating sliding sleeve; and setting the packer.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims: the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure.

The present disclosure generally relates to a system and method for completing a wellbore and production operations. More specifically, the present disclosure relates to a completion system, which may be installed in a single trip, and in which multiple operations may be carried out without the necessity of a service tool run from surface. Further, one or more embodiments of the present disclosure relate to completion systems having a circulation system that facilitates gravel packing, acid stimulation, slurry dehydration, and circulation without the use of a service tool for both cased and open holes.

Well completions with sand control such as a gravel pack, frac pack, acid stimulation, and frac stimulation conventionally involve a multiple number of trips into the well to install the completion tools and perform the operations. Each trip increases risk and time as well as cost. For example, at present, running an upper completion and an open hole gravel pack is completed in two separate trips. First, the open hole gravel pack is completed with a gravel pack service tool, which is used as a conveyance tool to first run and deploy certain hardware and secondly to pump a gravel pack in the open hole. The gravel pack service tool allows for multiple flow paths during the gravel packing operation. Once the gravel pack is completed, the upper completion is run in a separate trip.

One or more embodiments of the present disclosure relates to designing key components of a completion system such as a packer, screen system, and gravel pack sliding sleeve that will enable combining both the upper completion and the lower completion in a single trip with a gravel pack operation in an open hole. Moreover, one or more embodiments of the present disclosure relates to different sequences of fluid movement in order to achieve a gravel pack in a single trip. Advantageously, systems and methods according to one or more embodiments of the present disclosure may provide a circulation path for one or more of the following without the need for a service tool: open hole displacements, pumping gravel pack treatment fluids; reversing-out excess fluid, and displacing the casing to brine post-gravel pack treatment.

Figure 1:
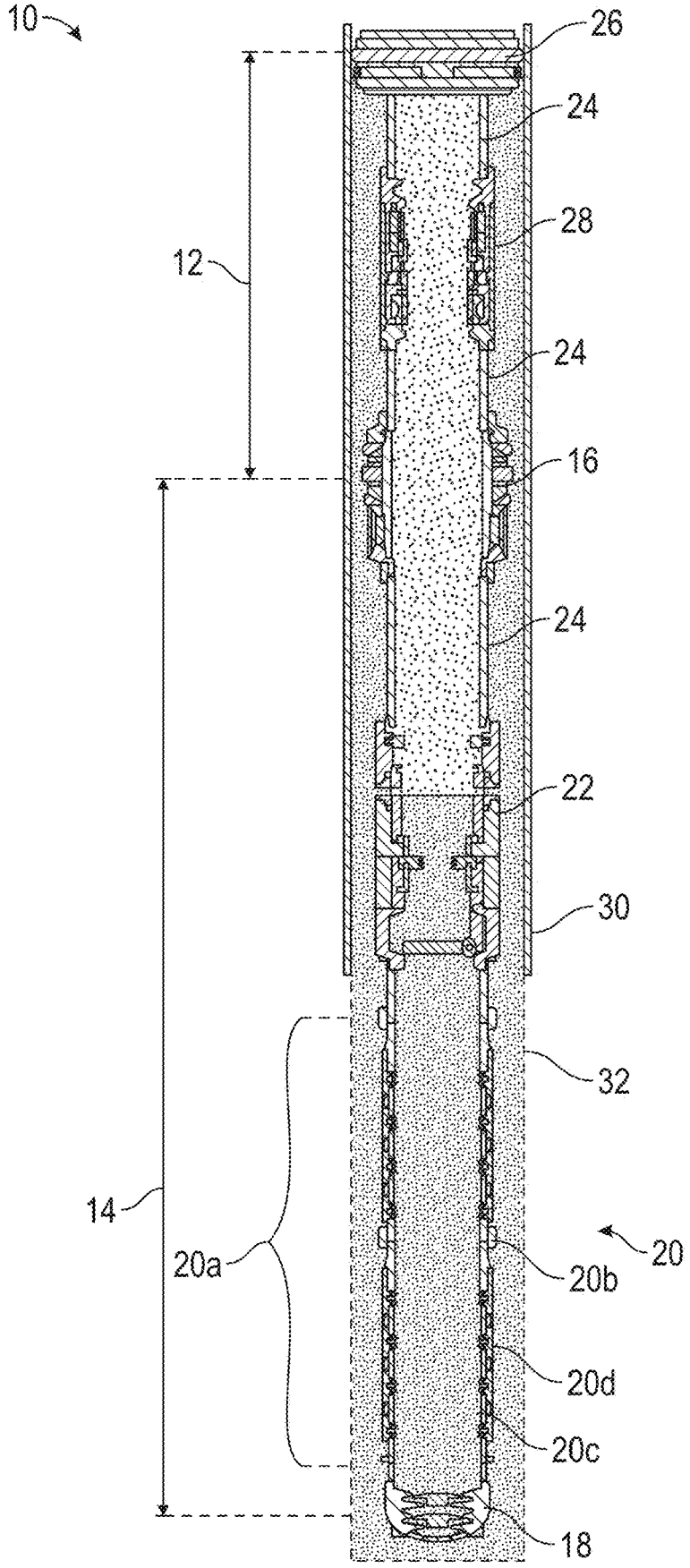
FIG. 1 shows a single trip completion string according to one or more embodiments of the present disclosure.

Referring now to FIG. 1, a single trip completion string according to one or more embodiments of the present disclosure is shown. Specifically, FIG. 1 shows a single trip completion string 10 that includes an upper completion 12 and a lower completion 14 below the upper completion 12. Moreover, in one or more embodiments of the present disclosure, the single trip completion string 10 includes a packer 16 disposed between the upper completion 12 and the lower completion 14. In one or more embodiments of the present disclosure, the packer 16 may be a production packer, for example.

Still referring to FIG. 1, in one or more embodiments of the present disclosure, the lower completion 14 may include a washdown shoe assembly 18 having at least one landing collar and a sand control assembly 20 disposed above the washdown shoe assembly 18. According to one or more embodiments of the present disclosure, the sand control assembly 20 includes at least one pair of screen joints 20*a* coupled at a screen joint connection 20*b*, each screen joint 20*a* including a base pipe 20*c* and a sand control screen 20*d* disposed around the base pipe 20*c*. Further, the lower completion 14 according to one or more embodiments of the present disclosure may also include a circulation sliding sleeve 22, which may be a remotely activated go/stop valve, as further described below. The lower completion 14 may also include production tubing 24 or blank pipe between the circulation sliding sleeve 22 and the packer 16.

Still referring to FIG. 1, the upper completion 12 may include a tubing hanger 26 for hanging the single trip completion string 10 in a wellbore and a safety valve 28 disposed below the tubing hanger 26. In one or more embodiments of the present disclosure, the safety valve 28 may be a tubing retrievable safety valve, for example. In one or more embodiments of the present disclosure, the upper completion 12 may also include production tubing 24 or blank pipe at least between the tubing hanger 26 and the safety valve 28, and between the safety valve 28 and the packer 16, for example. As further shown in FIG. 1, the wellbore may include a cased hole section 30 delineated by a casing, and an open hole section 32.

Figure 2A:
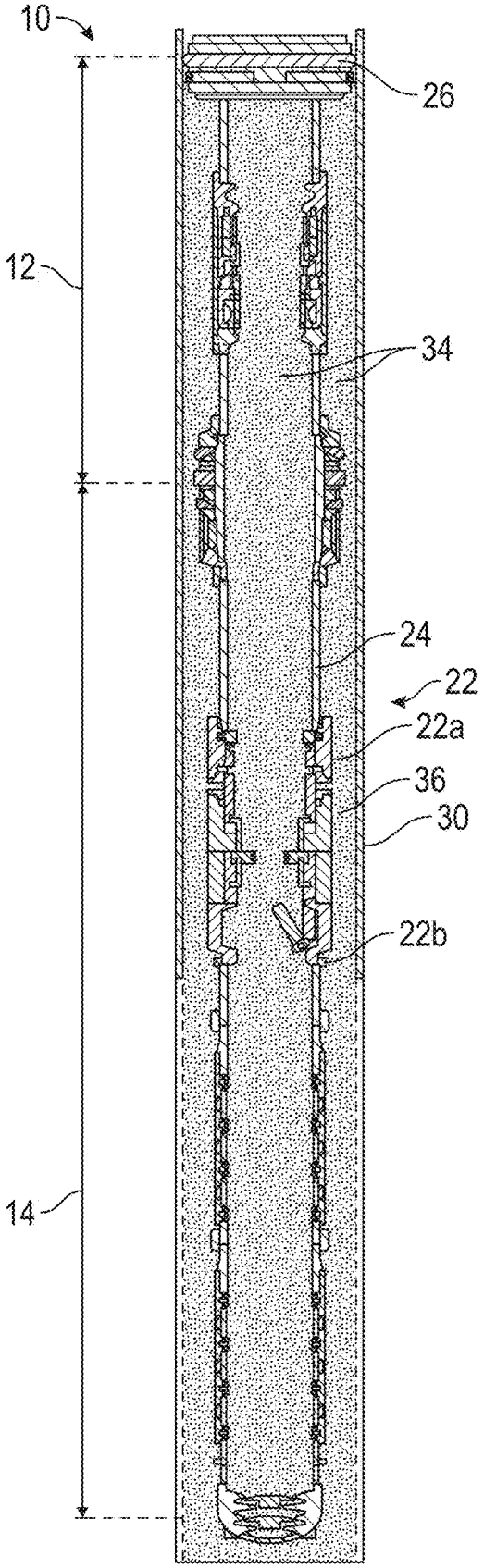
FIGS. 2A-2O show an operational go/stop sequence of gravel pack pumping according to one or more embodiments of the present disclosure.
Figure 2B:
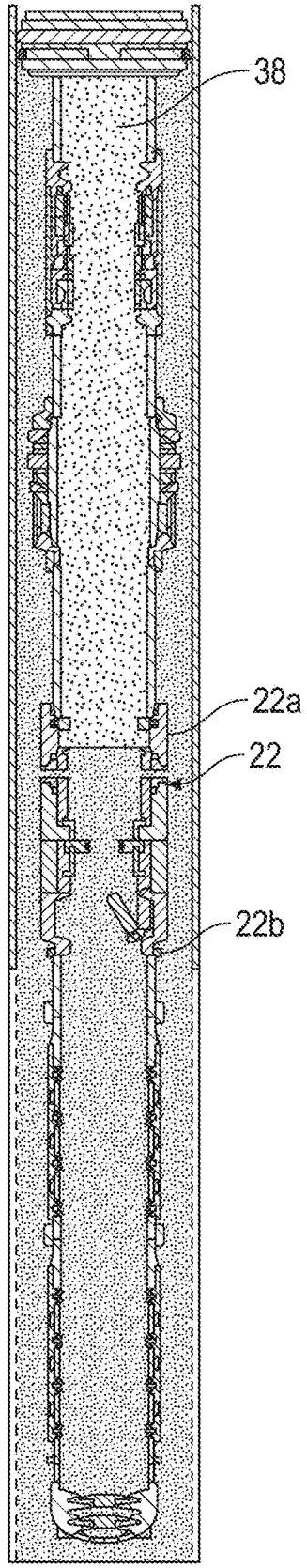
Figure 2C:
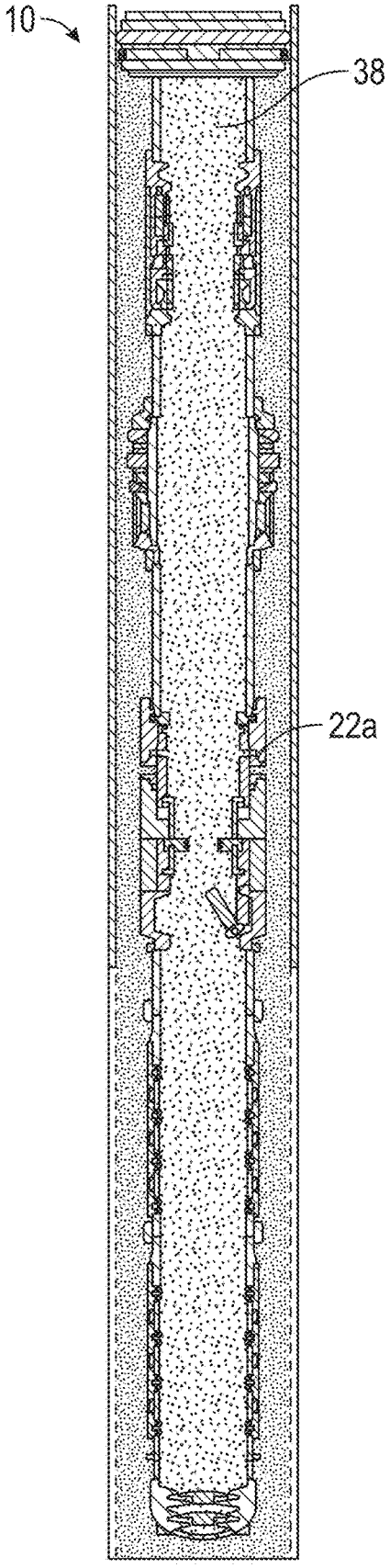
Figure 2D:
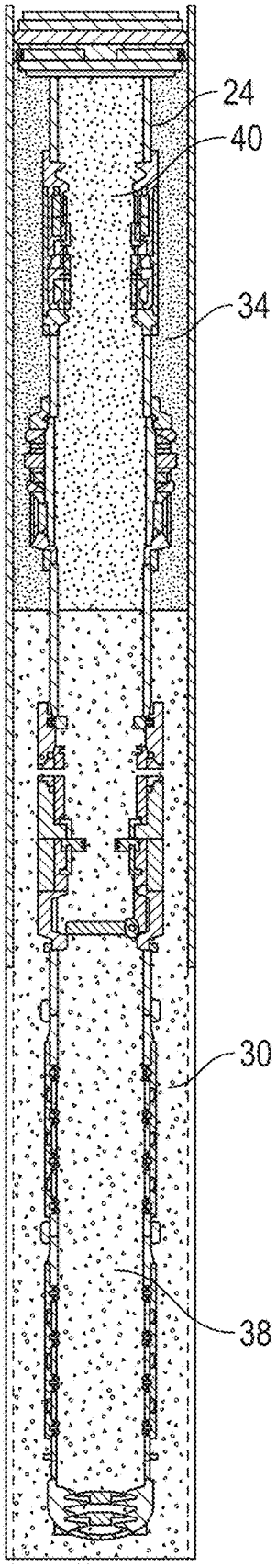
Figure 2E:
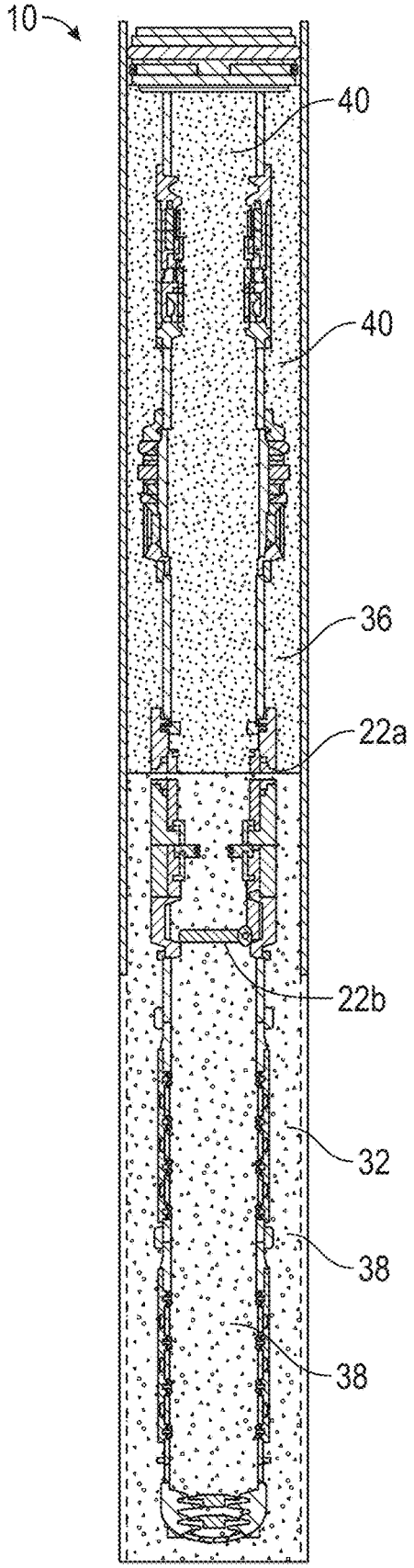
Figure 2F:
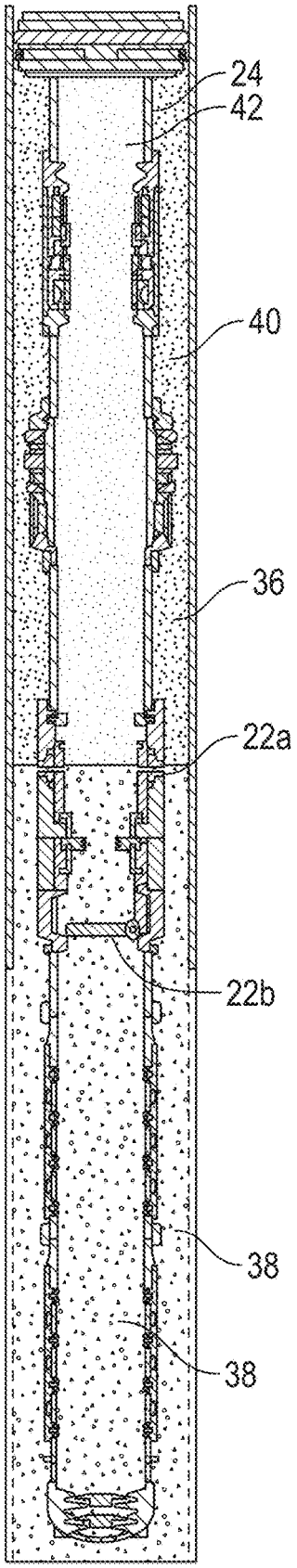
Figure 2G:
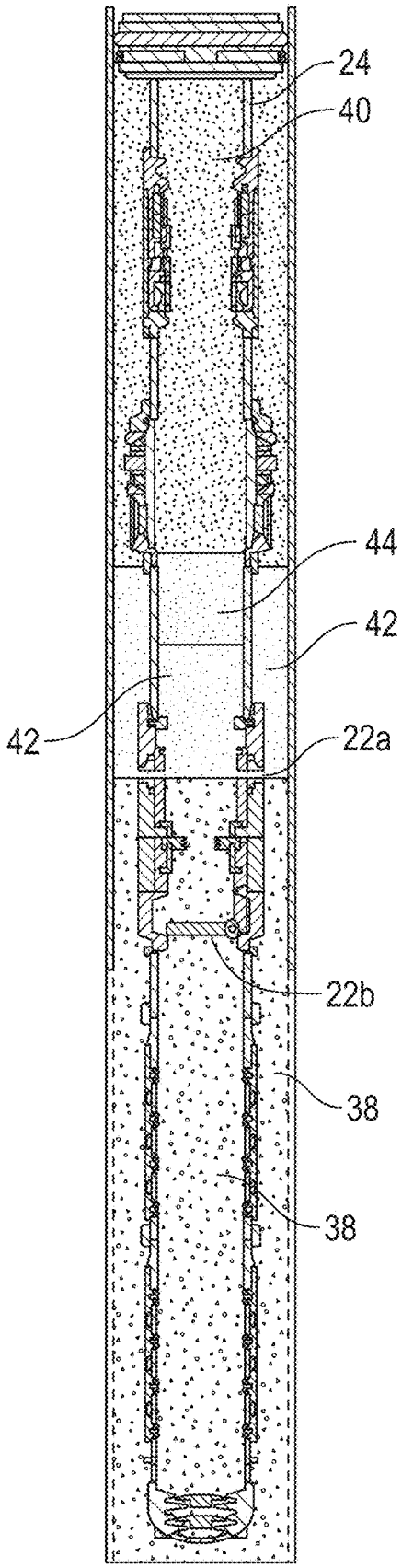
Figure 2H:
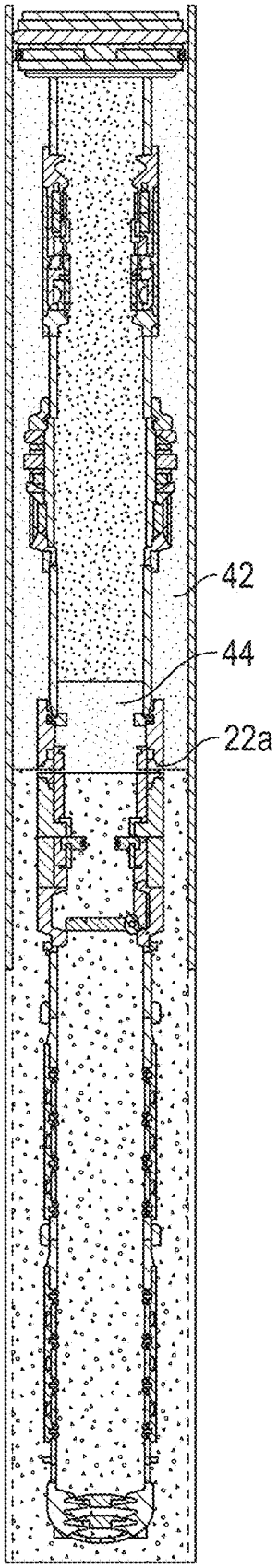
Figure 2I:
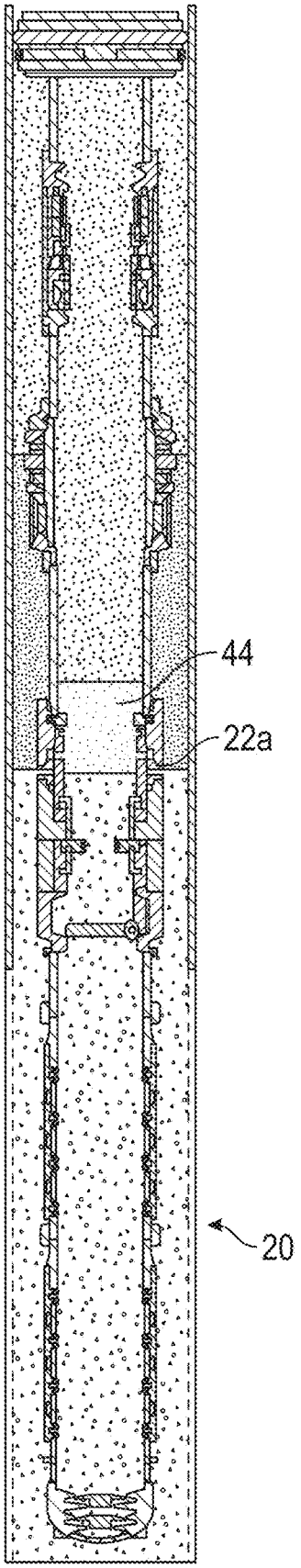
Figure 2J:
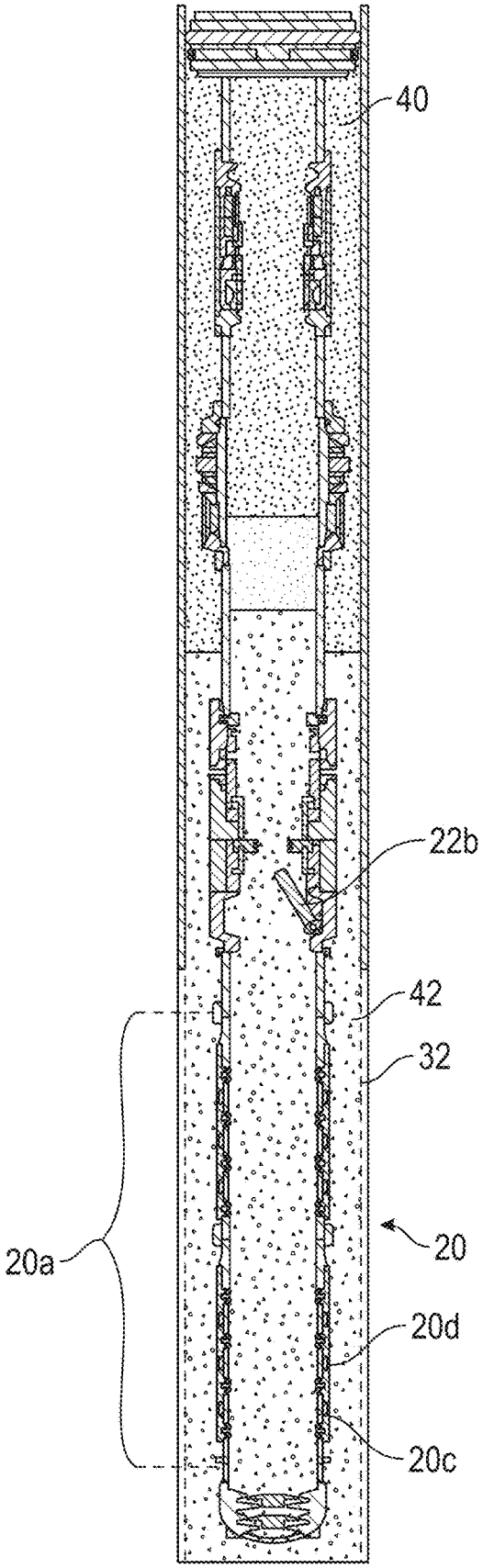
Figure 2K:
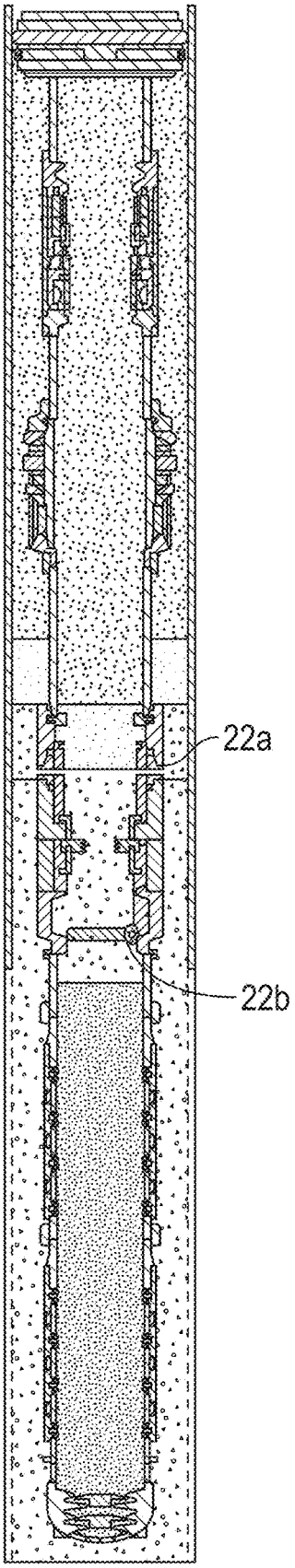
Figure 2L:
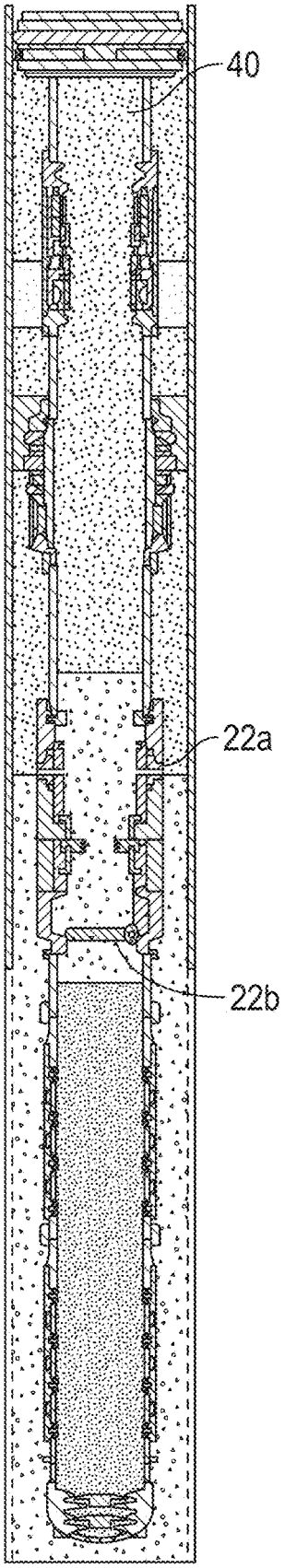
Figure 2M:
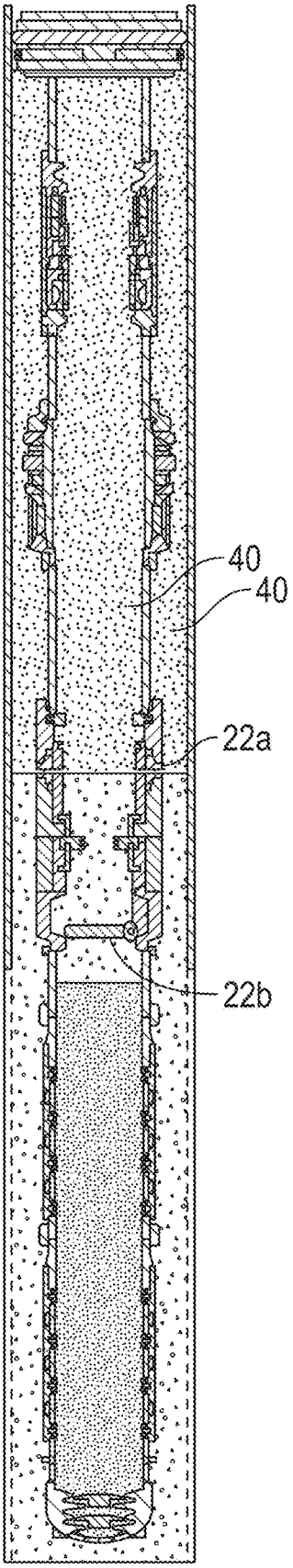
Figure 2N:
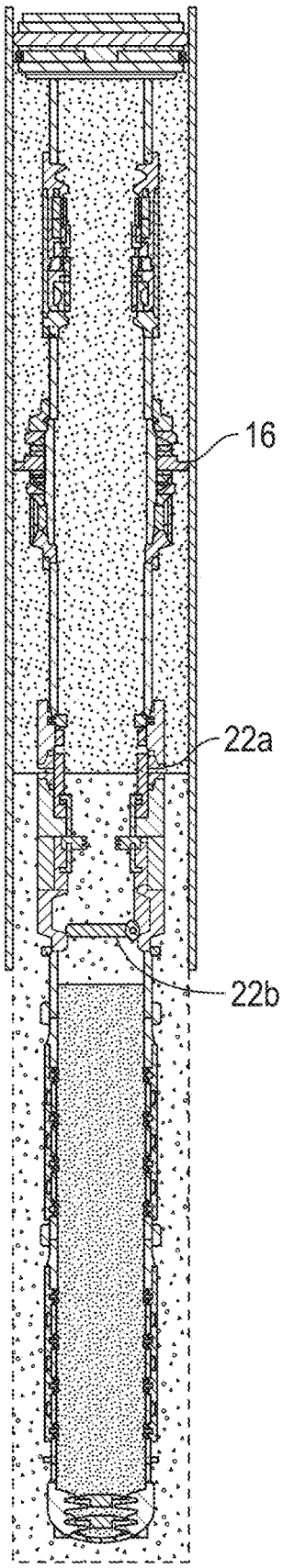
Figure 2O:
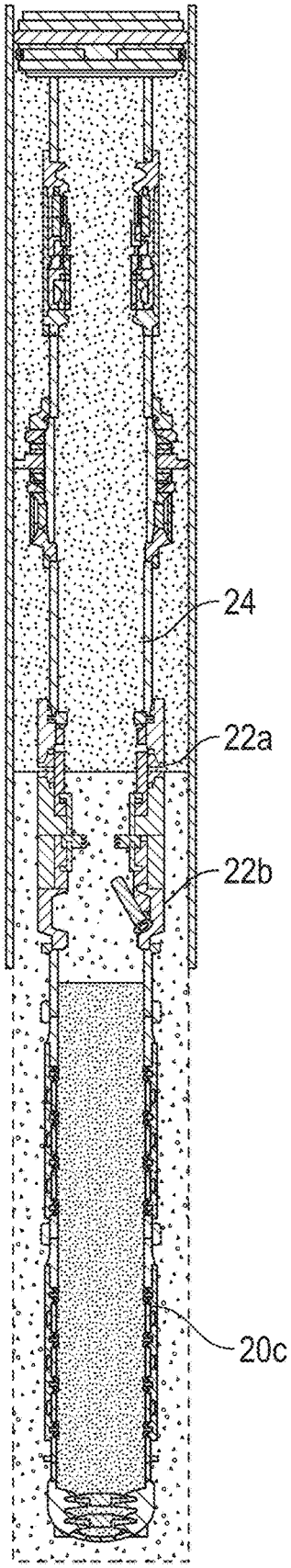

Referring now to FIGS. 2A-2O, an operational go/stop sequence of gravel pack pumping according to one or more embodiments of the present disclosure is shown. In a method according to one or more embodiments of the present disclosure, the wellbore may be drilled with a water-based or oil-based drilling mud, for example, and the single trip completion string 10 may be run into the wellbore and hung from the tubing hanger 26, as shown in FIG. 2A, for example. Insofar as the single trip completion string 10 according to one or more embodiments of the present disclosure includes the upper completion 12 and the lower completion 14, by running the single trip completion string 10 into a wellbore, the lower completion 14 and the upper completion 12 may be run into the wellbore simultaneously and within a single trip. As further shown in FIG. 2A, the wellbore may be full of a solid free mud 34 when the single trip completion string 10 is run into the wellbore.

Still referring to FIG. 2A, the circulation sliding sleeve 22 or go/stop valve of the single trip completion string 10 may include a circulating valve 22*a* and an inner diameter (ID) valve 22*b*, according to one or more embodiments of the present disclosure. In one or more embodiments of the present disclosure, the circulating valve 22*a* facilitates communication with an annulus 36 between the production tubing 24 and the cased hole section 30. In one or more embodiments of the present disclosure, the circulating valve 22*a* may open with a differential pressure in the ID of the single trip completion string 10, and may lock closed with annulus pressure. In one or more embodiments of the present disclosure, the ID valve 22*b* of the circulation sliding sleeve 22 or go/stop valve acts as a temporary plug for an inner diameter of the single trip completion string 10. In one or more embodiments of the present disclosure, the ID valve 22*b* may be a flapper valve, a ball valve, or any other type of valve that is capable of temporarily plugging the ID of the single trip completion string 10. According to one or more embodiments of the present disclosure, the ID valve 22b may be activated via a trigger and may be closed, and may be locked open remotely or during well unloading. As shown in FIG. 2A, the single trip completion string 10 is run in hole with the ID valve 22*b* of the circulating sliding sleeve 22 or go/stop valve in the open position, and with the circulating valve 22*a* of the circulating sliding sleeve 22 or go/stop valve in the closed position.

Referring now to FIG. 2B, after the single trip completion string 10 is run in hole, the circulating valve 22*a* of the circulation sliding sleeve 22 or go/stop valve is opened, and open hole displacement fluid 38 is pumped down to a depth of the circulating valve 22*a*. As shown in FIG. 2C, the circulating valve 22*a* is then closed, and pumping of the open hole displacement fluid 38 continues, filling the ID of the single trip completion string 10. As shown in FIG. 2D, pumping of brine 40 into the tubing 24 of the single trip completion string 10 displaces the open hole displacement fluid 38 through the ID of the single trip completion string 10, out of the washdown shoe assembly 18, and into the annulus 36, pushing the solid free mud 34 out of the open hole. As shown in FIG. 2E, in the operational method according to one or more embodiments of the present disclosure, the ID valve 22*b* of the circulation sliding sleeve 22 or go/stop valve is closed, and the circulating valve 22*a* of the circulation sliding sleeve 22 or go/stop valve is opened, which allows the pumped brine 40 to enter the annulus 36. In this way, the brine 40 circulates in and out of the single trip completion string 10 via the circulating valve 22*a* instead of pushing into the open hole section 32 of the wellbore. Thereafter, as shown in FIG. 2F, a required volume of slurry 42 is pumped into the tubing 24 of the single trip completion string 10 while the circulating valve 22*a* remains open and the ID valve 22*b* remains closed, which pushes any brine 40 remaining in the tubing 24 of the single trip completion string 10 into the annulus 36. In one or more embodiments of the present disclosure, the slurry 42 may include a water or oil based viscous carrier fluid and gravel or proppant, for example. Next, as shown in FIG. 2G, pumping of the slurry 42 continues while the circulating valve 22*a* remains open and the ID valve 22*b* remains closed, causing the slurry 42 to begin to occupy the annulus above the circulating valve 22*a*, which displaces some of the brine 40 that occupied the annulus 36. As further shown in FIG. 2G, spacer fluid 44 is introduced into the tubing 24 of the single trip completion string 10 behind the slurry 42, and additional brine 40 is pumped into the tubing 24 of the single trip completion string 10 behind the spacer fluid 44 to facilitate efficient displacement of the gravel or proppant from the slurry 42. As shown in FIG. 2H, the pumping continues until the spacer fluid 44 reaches the circulating valve 22*a*. At this stage, all of the treatment fluid (i.e., the slurry 42) is above the circulating valve 22*a* in the annulus. Because the slurry 42 is a viscous fluid, the gravel or proppant stays in suspension. Then, as shown in FIG. 2I, the pumping is stopped and the circulating valve 22*a* is closed. At this stage, the gravel or proppant in the slurry 42 begins moving down the annulus and into the open hole section 32 near the sand control assembly 20, according to one or more embodiments of the present disclosure. Then, as shown in FIG. 2J, pumping brine 40 into the annulus begins, which facilitates further movement of the slurry 42 into the open hole section of the wellbore. Once in the open hole section, the slurry 42 filters through the screen joints 20*a*, leaving the gravel or proppant in the annulus of the open hole section, and the returns of carrier fluid from the slurry 42 enter the base pipe 20*c* for returning to the surface. In one or more embodiments of the present disclosure, the returns cause the ID valve 22*b* to open. The sand control screen 20*d* of the screen joints 20*a* according to one more embodiments of the present disclosure may include a check valve, a sliding sleeve door (SSD), or a three way sub system, as further described below, for example. Once screen out of the gravel packing operation is achieved, the circulating valve 22*a* is opened, and excess slurry 42 is circulated out of the single trip completion string 10, as shown in FIG. 2K, for example. As shown in FIGS. 2L and 2M, in one or more embodiments of the present disclosure, brine 40 is pumped into the inner diameter of the tubing 24 while the circulating valve 22*a* remains open and the ID valve 22*b* remains closed, which causes the brine 40 to enter the annulus above the circulating valve 22*a*. This pumping of brine 40 continues until both the inner diameter of the tubing 24 and the annulus are full of brine 40 and clean, as shown in FIG. 2M, for example. At this stage, pumping of the brine 40 is stopped. Thereafter, as shown in FIG. 2N, the circulating valve 22*a* is closed, and the packer 16 is set, according to one or more embodiments of the present disclosure. The packer 16 may be set hydraulically or hydrostatically, for example, according to one or more embodiments of the present disclosure. Thereafter, as shown in FIG. 2O, the circulating valve 22*a* may be permanently locked closed, and the ID valve 22*b* may be opened to facilitate production through the base pipe 20*c* and the production tubing 24 of the single trip completion string 10.

Figure 3A:
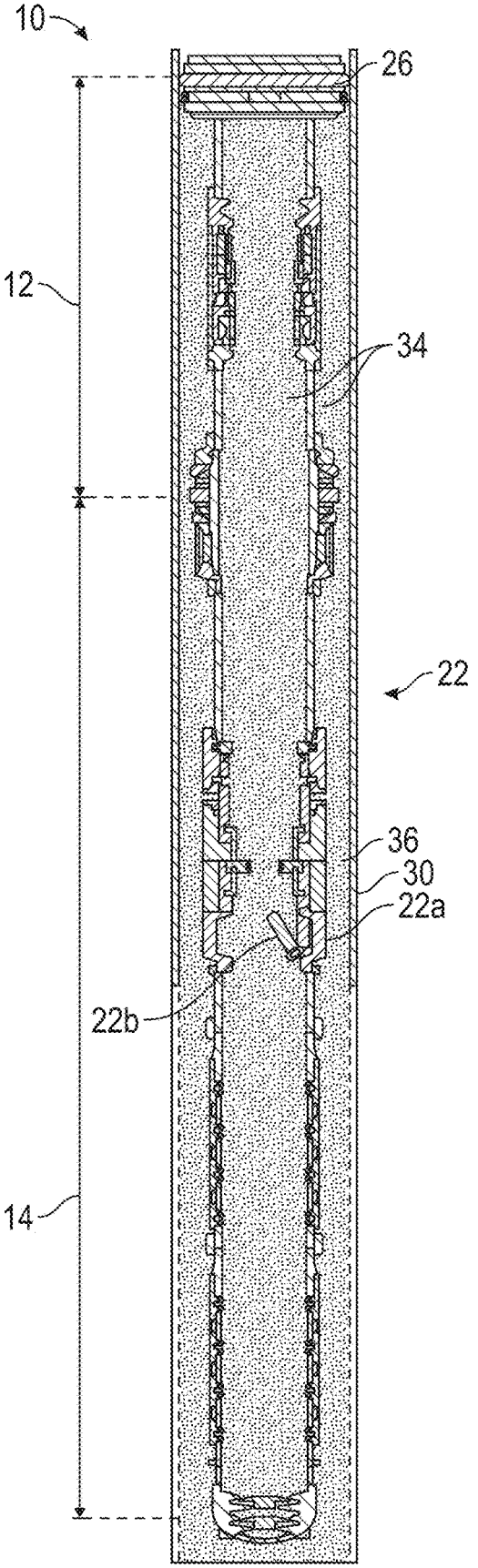
FIGS. 3A-3L show an operational go/stop sequence of high solid content fluids pumping according to one or more embodiments of the present disclosure.

Referring now to FIGS. 3A-3L, an operational go/stop sequence of high solid content fluids pumping according to one or more embodiments of the present disclosure is shown. In a method according to one or more embodiments of the present disclosure, the wellbore may be drilled with a water-based or oil-based drilling mud, for example, and the single trip completion string 10 may be run into the wellbore and hung from the tubing hanger 26, as shown in FIG. 3A, for example. Insofar as the single trip completion string 10 according to one or more embodiments of the present disclosure includes the upper completion 12 and the lower completion 14, by running the single trip completion string 10 into a wellbore, the lower completion 14 and the upper completion 12 may be run into the wellbore simultaneously and within a single trip. As further shown in FIG. 3A, the wellbore may be full of a solid free mud 34 when the single trip completion string 10 is run into the wellbore. Still referring to FIG. 3A, the single trip completion string 10 is run in hole with the ID valve 22*b* of the circulating sliding sleeve 22 or go/stop valve in the open position, and with the circulating valve 22*a* of the circulating sliding sleeve 22 or go/stop valve in the closed position.

Figure 3B:
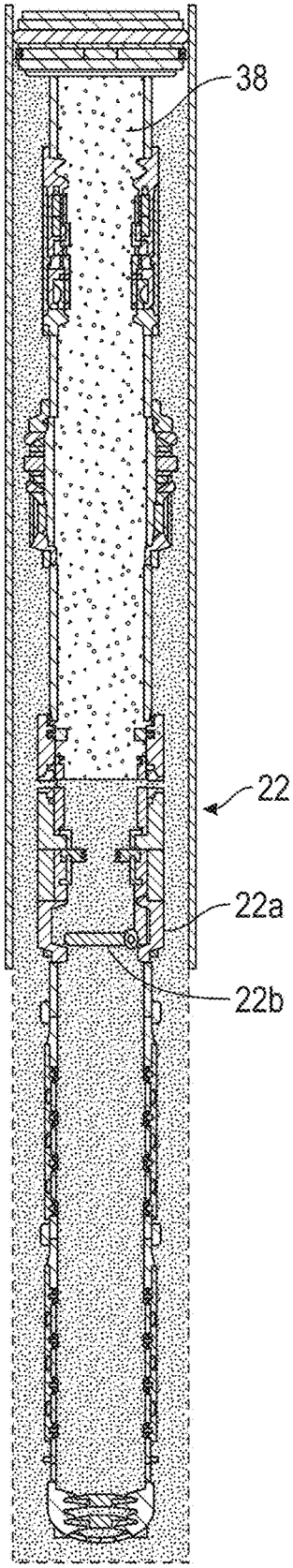
Figure 3C:
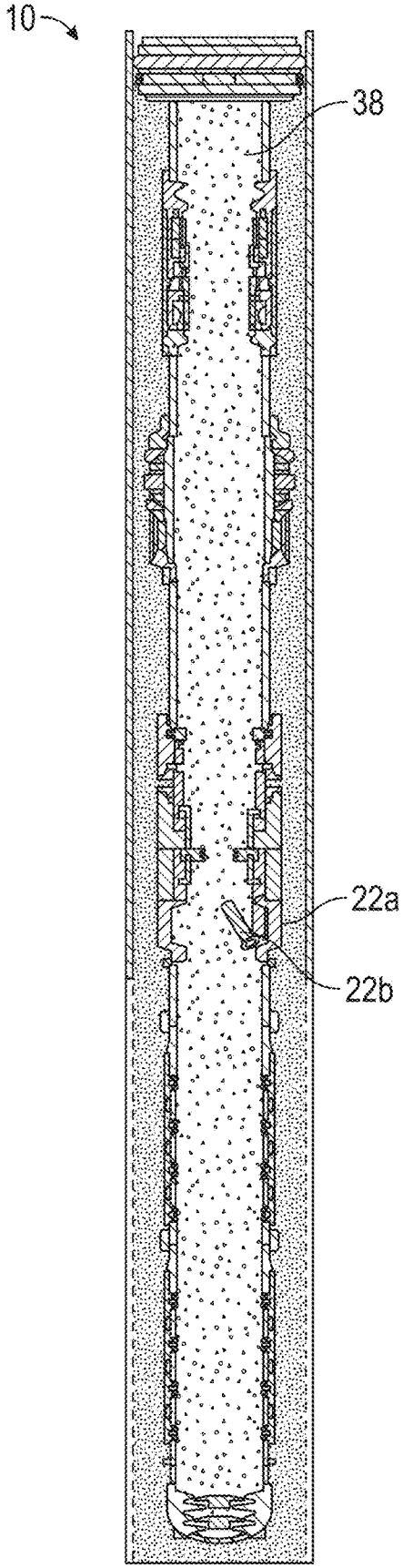
Figure 3D:
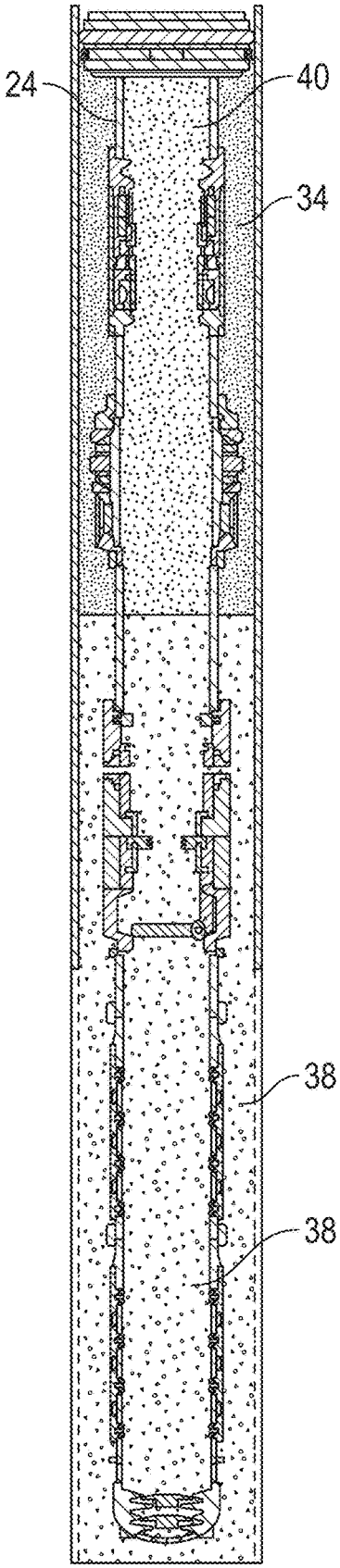
Figure 3E:
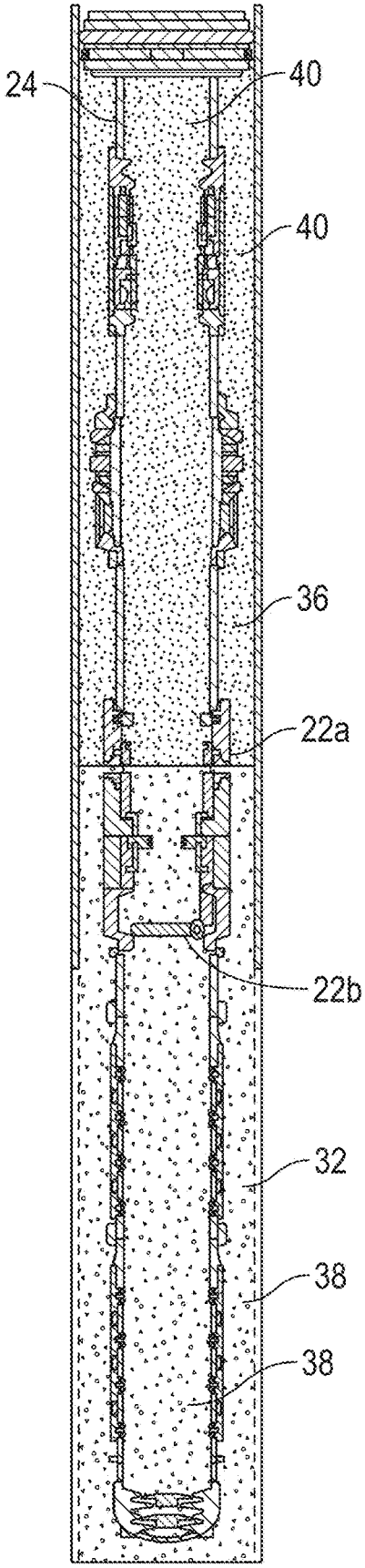

Referring now to FIG. 3B, after the single trip completion string 10 is run in hole, the circulating valve 22*a* of the circulating sliding sleeve 22 or go/stop valve is opened, the ID valve 22*b* is closed, and open hole displacement fluid 38 is pumped down to a depth of the circulating valve 22*a*. As shown in FIG. 3C, the circulating valve 22*a* is then closed, the ID valve 22*b* is then opened, and pumping of the open hole displacement fluid 38 continues, filling the ID of the single trip completion string 10. As shown in FIG. 3D, pumping of brine 40 into the tubing 24 of the single trip completion string 10 displaces the open hole displacement fluid 38 through the ID of the single trip completion string 10, out of the washdown shoe assembly 18, and into the annulus 36, pushing the solid free mud 34 out of the open hole. As shown in FIG. 3E, in the operational method according to one or more embodiments of the present disclosure, the ID valve 22*b* of the circulation sliding sleeve 22 or go/stop valve is closed, and the circulating valve 22*a* of the circulation sliding sleeve 22 or go/stop valve is opened, which allows the pumped brine 40 to enter the annulus 36. In this way, the brine 40 circulates in and out of the single trip completion string 10 via the circulating valve 22*a* instead of pushing into the open hole section 32 of the wellbore.

Figure 3F:
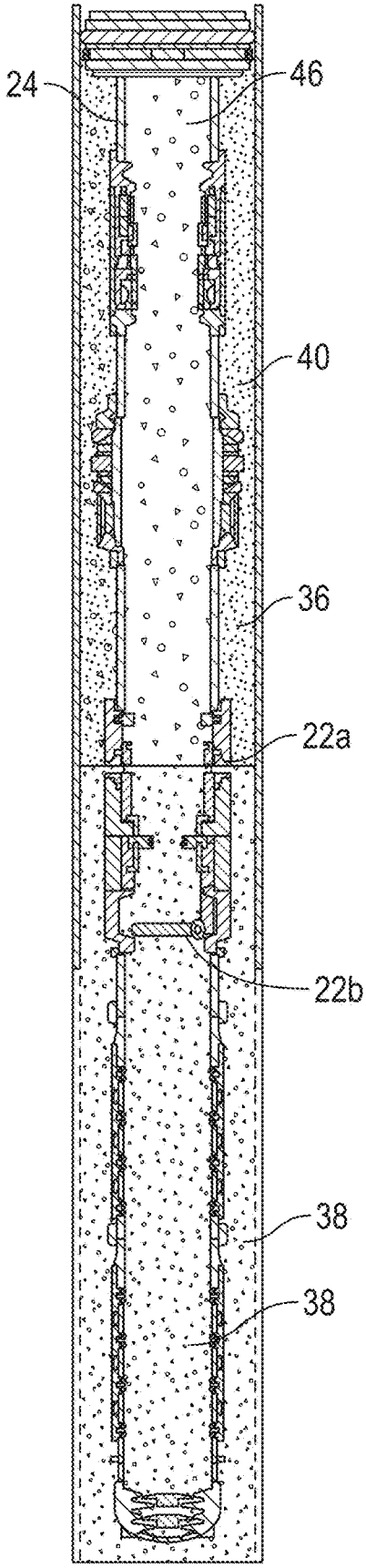

Thereafter, as shown in FIG. 3F, a required volume of high solids content gravel pack fluid (HSCGPF) 46 is pumped into the tubing 24 of the single trip completion string 10 while the circulating valve 22*a* remains open and the ID valve 22*b* remains closed, which pushes any brine 40 remaining in the tubing 24 of the single trip completion string 10 into the annulus 36. In one or more embodiments of the present disclosure, the HSCGPF 46 may include a carrier fluid and a plurality of amounts of particulates combined into a slurry. In one or more embodiments of the present disclosure, the HSCGPF 46 may include first, second, third, fourth, and more amounts of particulates, each of the amounts of particulates having an average size distribution. For example, a first average size distribution of the first amount of particulates may be at least three times larger than a second average size distribution of the second amount of particulates, the second average size distribution may be larger than a third average size distribution of the third amount of particulates, and the third average size distribution may be larger than the fourth average size distribution. According to one or more embodiments of the present disclosure, the first average size distribution may include a swellable gravel or proppant, the second average size distribution may include a coated solid acid, such as polylactic acid (PLA) or polyglycolic acid (PGA), for example, and the third and fourth average size distributions may include one or more of PLA, PGA, and calcium carbonate. Further, in one or more embodiments of the present disclosure, the HSCGPF 46 may include a shale inhibitor, for example. In such embodiments of the present disclosure, the shale inhibitor may include an acrylamide based polymer, lignosulfonate, an amine, or a combination of these, for example.

Figure 3G:
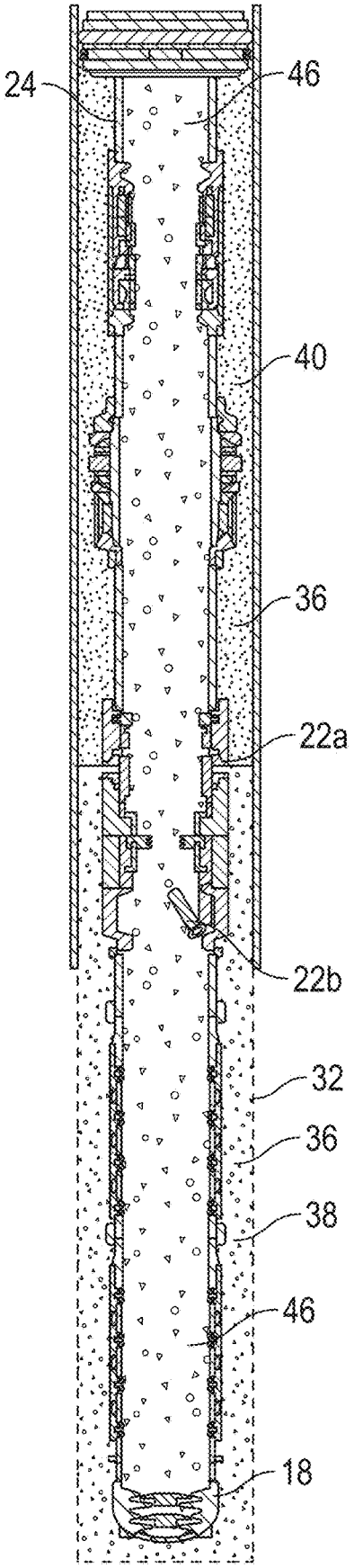
Figure 3H:
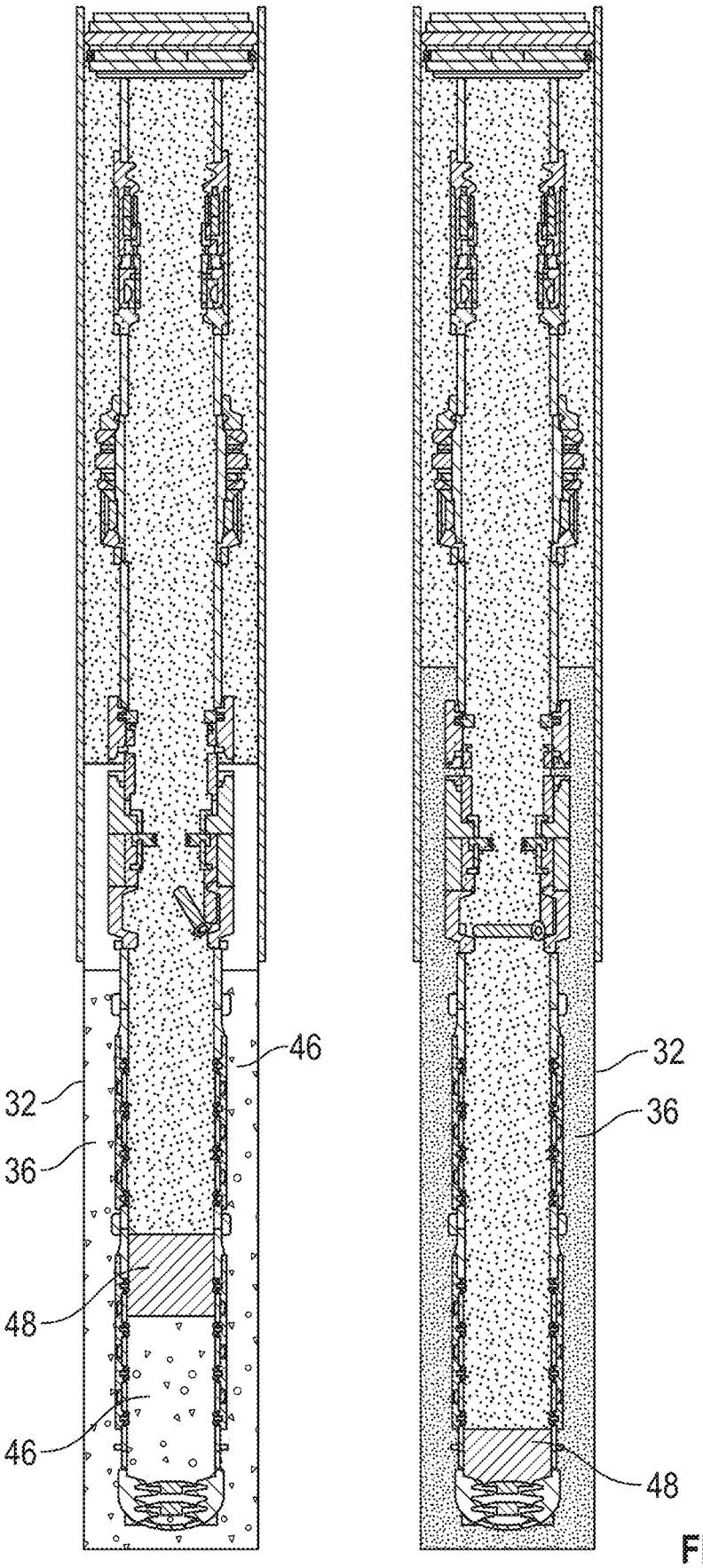

Next, as shown in FIG. 3G, the circulating valve 22*a* is closed, the ID valve 22*b* is opened, and pumping of the HSCGPF 46 into the tubing 24 of the single trip completion string 10 continues. As the pumping of the HSCGPF 46 continues, the HSCGPF 46 reaches a depth of the washdown shoe assembly 18, which displaces the open hole displacement fluid 38 into the annulus 36 of the open hole section 32 via the washdown shoe assembly 18. In one or more embodiments of the present disclosure, the HSCGPF 46 may be pumped into the tubing 24 of the single trip completion string 10 along with at least one mechanical plug 48 as the circulating valve 22*a* remains closed and the ID valve 22*b* remains open, as shown in FIG. 3H, for example. In one or more embodiments of the present disclosure, the at least one mechanical plug 48 may be a wiper plug or a cement plug, for example. As further shown in FIG. 3H, as the pumping of the HSCGPF 46 continues, the HSCGPF 46 begins to enter the annulus 36 of the open hole section 32 via the washdown shoe assembly 18 until the at least one mechanical plug 48 reaches and is retained in the washdown shoe assembly 18 and the HSCGPF 46 is deposited in the annulus 36 of at least the open hole section 32 of the wellbore. By being retained in the washdown shoe assembly 18 in this way, the at least one mechanical plug 48 is able to act as an isolation barrier.

Figure 3I:
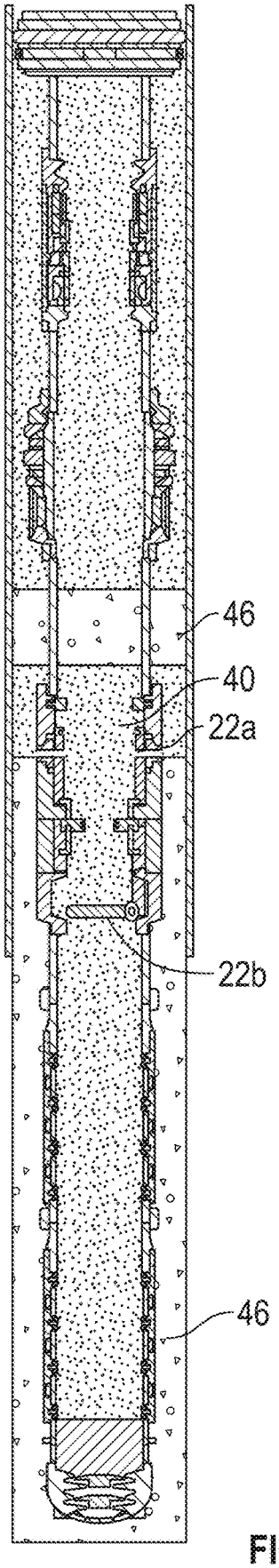
Figure 3J:
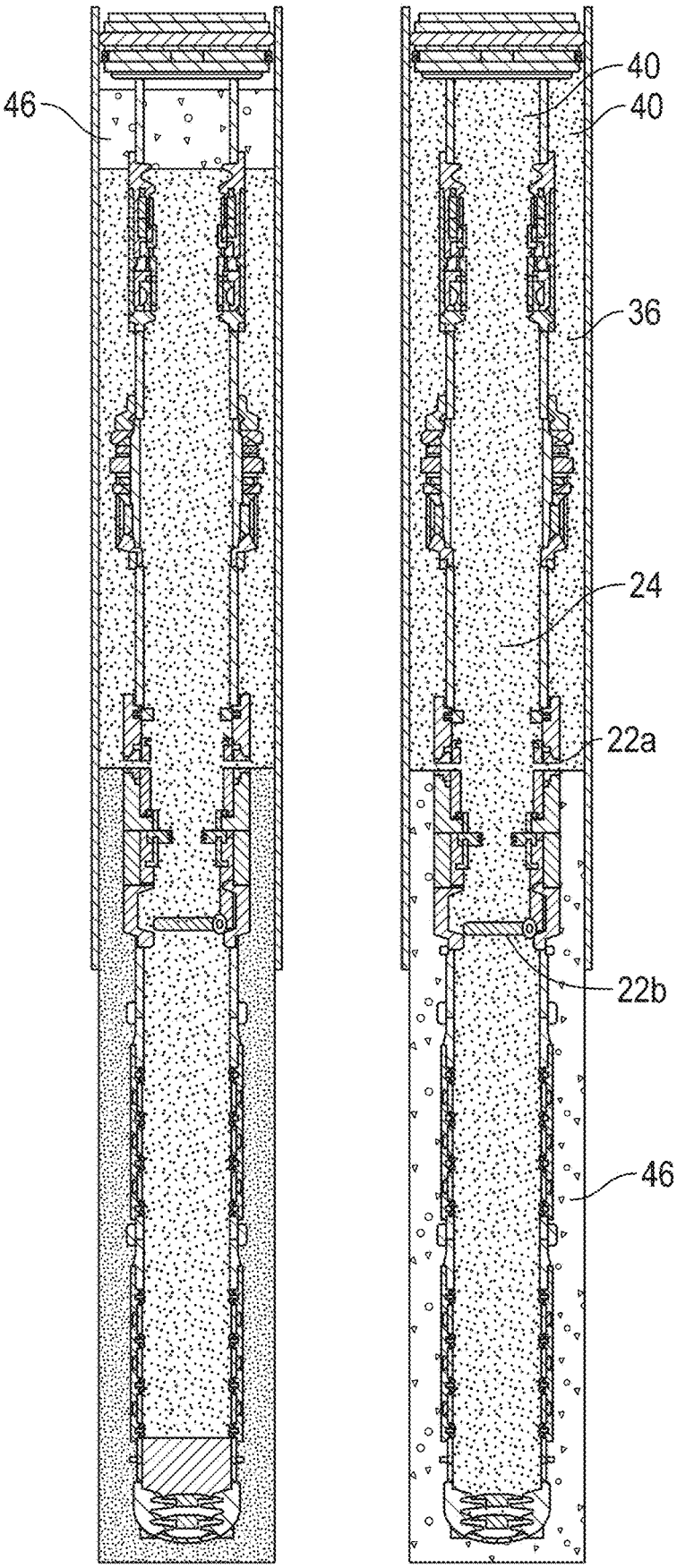

Then, as shown in FIG. 3I, the pumping of the HSCGPF 46 is stopped, the circulating valve 22*a* is opened, the ID valve 22*b* is closed, and reversing out excess HSCGPF 46 above the circulating valve 22*a* begins. As shown in FIG. 3J, reversing out excess HSCGPF 46 continues while the circulating valve 22*a* remains open and the ID valve 22*b* remains closed until both the tubing 24 and the annulus 36 above the circulating valve 22*a* are clear. In one or more embodiments of the present disclosure, the excess HSCGPF 46 may be reversed out using brine 40 or other completion fluid, as shown in FIG. 3J, for example.

Figure 3K:
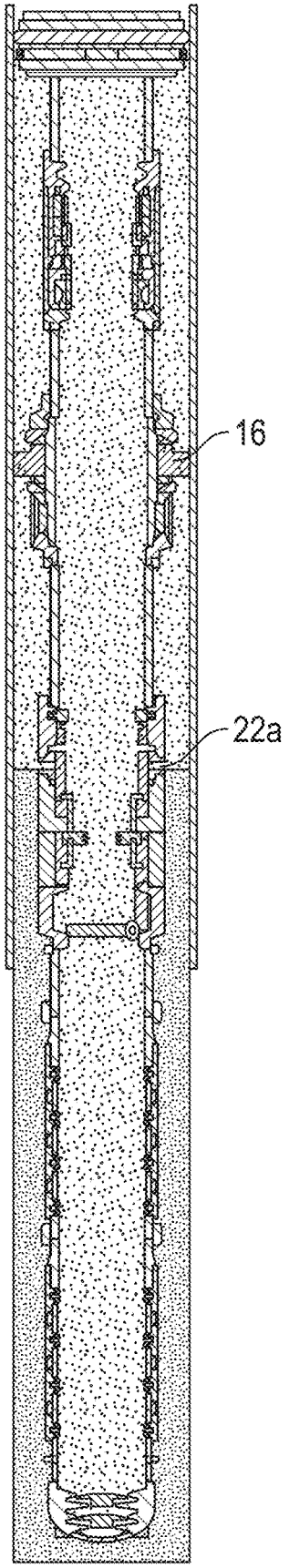
Figure 3L:
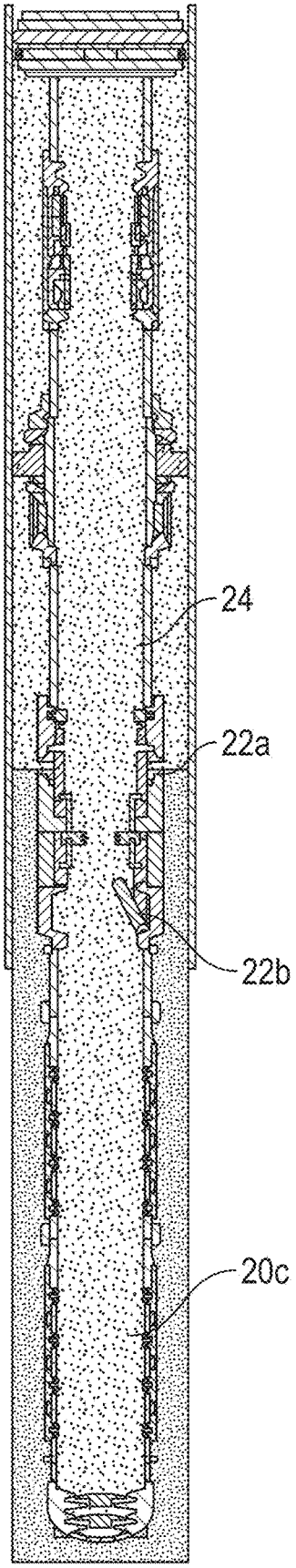

Thereafter, as shown in FIG. 3K, the circulating valve 22*a* is closed, and the packer 16 is set, according to one or more embodiments of the present disclosure. The packer 16 may be set hydraulically or hydrostatically, for example, according to one or more embodiments of the present disclosure. Thereafter, as shown in FIG. 3L, the circulating valve 22*a* may be permanently locked closed, and the ID valve 22*b* may be opened to facilitate production through the base pipe 20*c* and the production tubing 24 of the single trip completion string 10.

Figure 4:
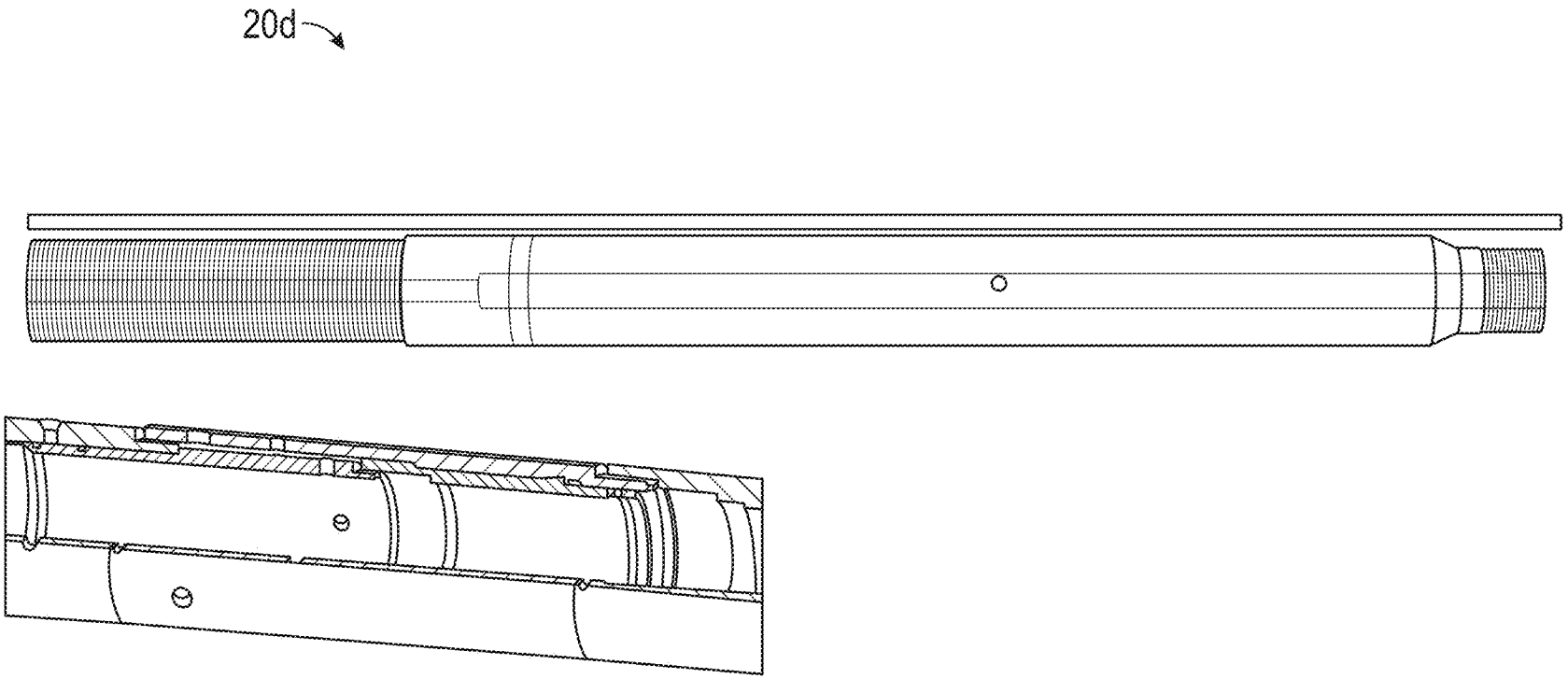
FIGS. 4-6 show different configurations of screens that may be included in the single trip completion string according to one or more embodiments of the present disclosure.

As previously described, the single trip completion string 10 according to one or more embodiments of the present disclosure may include a sand control assembly 20 including at least one pair of screen joints 20*a* coupled at a screen joint connection 20*b*, each screen Page 2 of 12 Schlumberger-Private Application No.: 18/044,387 Response to Office Action dated Jun. 6, 2024 joint 20*a* including a base pipe 20*c* and a sand control screen 20*d* disposed around the base pipe 20*c*. Different configurations of the sand control screen 20*d* are contemplated and are within the scope of the present disclosure. For example, in one or more embodiments of the present disclosure, the sand control screen 20*d* of the sand control assembly 20 may include at least one of a wire wrap screen, a premium mesh screen, and an alternating path screen. As shown in FIG. 4, for example, the sand control screen 20*d* may include a premium port float screen that is compatible with open hole alternate path gravel packing systems, such as OptiPac, for example. Advantageously, the premium port float screen provides gravel and sand retention during production mode, while the float valve facilitates running screens having washdown capabilities without the need for a washpipe. With the selection of the premium port float screen configuration for the sand control screen 20*d*, the main method of gravel packing may be through shunt tubes of the alternate path system. According to one or more embodiments of the present disclosure, the float valve may have multiple configurations including one time remote activation to an open position by applying tubing pressure, one time remote activation to an open position and remote activation to a closed position with the use of hydraulic pressure and an eTrigger, and multiple time remote activation to open and closed positions when running on an electric line.

Figure 5:
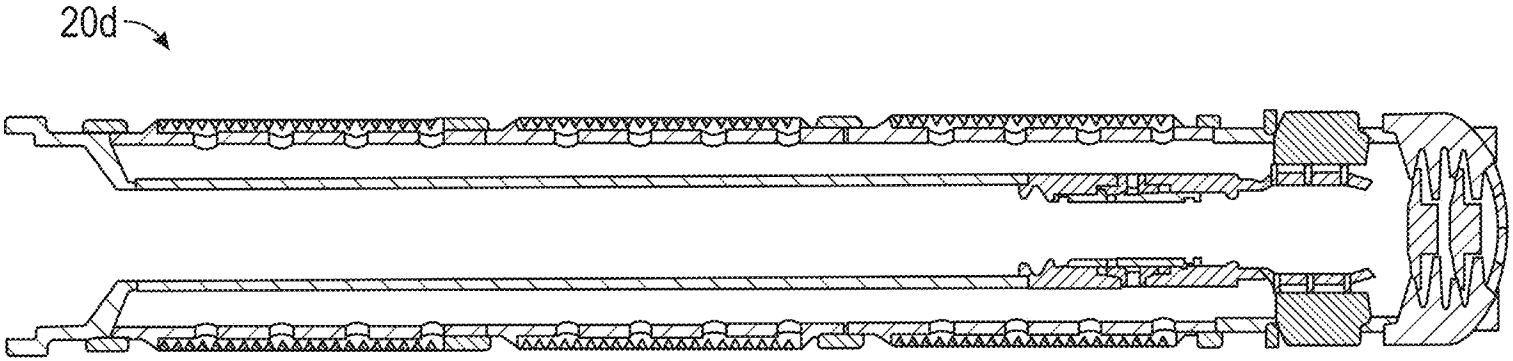

As further shown in FIG. 5, the sand control screen 20*d* may assume the configuration of a three-way sub system with a remotely activated SSD, according to one or more embodiments of the present disclosure. In one or more embodiments, the three-way sub system shown in FIG. 5 may include a conventional screen and an isolation string that is connected on the top of the screen through the three-way sub with sealing on the bottom at a polished bore receptacle. Further, an inner string of the system includes tubing and at least one remotely activated SSD for production purposes, which may be kept in a closed position during installation, except for the deepest SSD, which may be activated earlier for gravel packing purposes. Advantageously, the three-way sub system with at least one remotely activated SSD may be run with any type of screen and with open hole alternate path gravel packing systems, such as OptiPac, or for open hole gravel packing operations where brine is used to place gravel around pre-installed screens, such as AquaPac, in one or more embodiments of the present disclosure.

Figure 6:
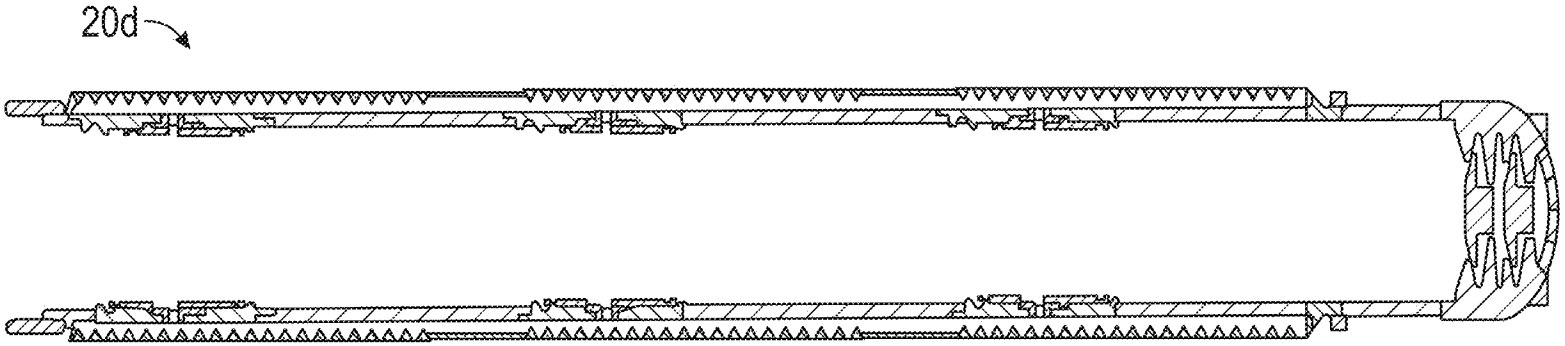

As further shown in FIG. 6, the sand control screen 20*d* may assume the configuration of a multizone screen system, such as the MZ-Xpress screen, according to one or more embodiments of the present disclosure. In one or more embodiments of the present disclosure, the multizone screen system may include an un-perforated base pipe, and may have an external connection that allows for independent hydraulic connectivity in the ID and in the annulus space between the screen filter and the base pipe. In between the screen joints of the multizone screen system, multiple remotely activated valves may be placed for production purposes. These valves may be run in hole in a closed position, and only the deepest valve may be remotely activated prior to gravel packing operations. Advantageously, the multizone screen system with at least one remotely activated SSD may be run with open hole alternate path gravel packing systems, such as OptiPac, or with open hole gravel packing systems where brine is used to place gravel around pre-installed screens, such as AquaPac, according to one or more embodiments of the present disclosure.

In addition to the above, the sand control screen 20*d* according to one or more embodiments of the present disclosure may include at least one of a check valve, a sliding sleeve, and a dissolvable material, film, or coating, for example. In embodiments of the present disclosure where the sand control screen 20*d* includes a sliding sleeve, the sliding sleeve may be activated hydraulically, mechanically, remotely, or any combination of these.

Figure 7:
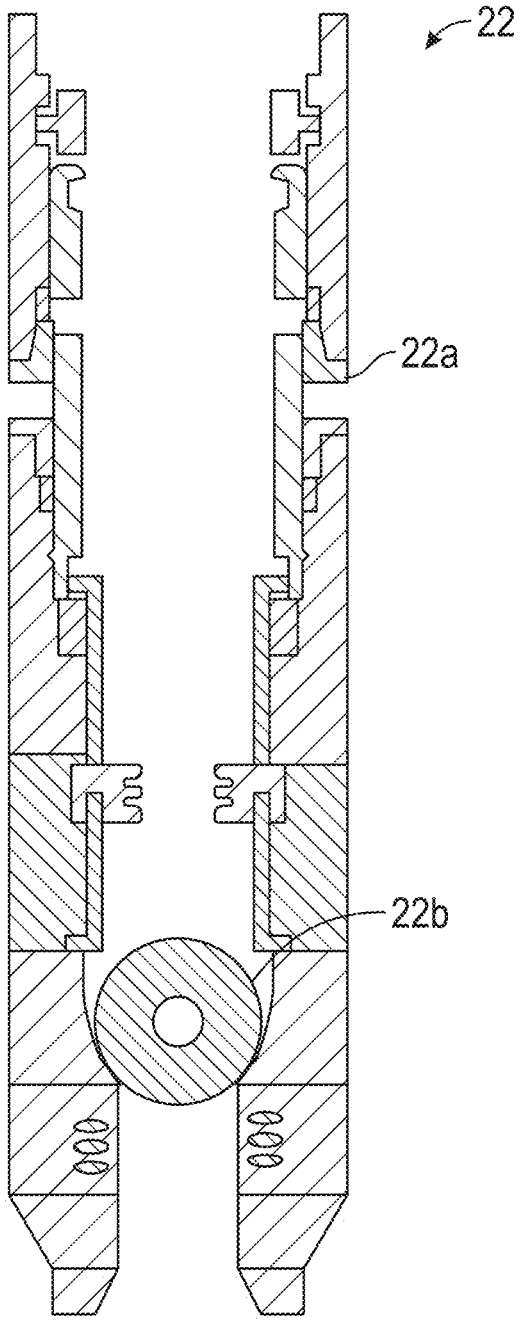
FIGS. 7-8D show different configurations of remotely activated go/stop valves that may be included in the single trip completion string according to one or more embodiments of the present disclosure.

As previously described, the single trip completion string 10 may include a circulating sliding sleeve 22, which may be a remotely activated go/stop valve including a circulating valve 22*a* and an ID valve 22*b*, according to one or more embodiments of the present disclosure. As previously described with respect to FIGS. 2A-2O and FIGS. 3A-3L, the ID valve 22*b* of the remotely activated go/stop valve 22 may be a flapper valve, for example. However, the ID valve 22*b* may be a ball valve as shown in FIG. 7, for example, according to one or more embodiments of the present disclosure. In one or more embodiments, remotely activated go/stop valve 22 having a ball valve as the ID valve 22*b* may be controlled by a dual hydraulic control line, or by an electrical line that allows the remotely activated go/stop valve 22 to assume two positions: a first position in which the ball valve 22*b* is open, and the circulating valve 22*a* is closed; and a second position in which the ball valve 22*b* is closed and the circulating valve 22*a* is opened. Further, in one or more embodiments of the present disclosure, the circulating valve 22*a* may have one direction flow from internal to external.

Figure 8C:
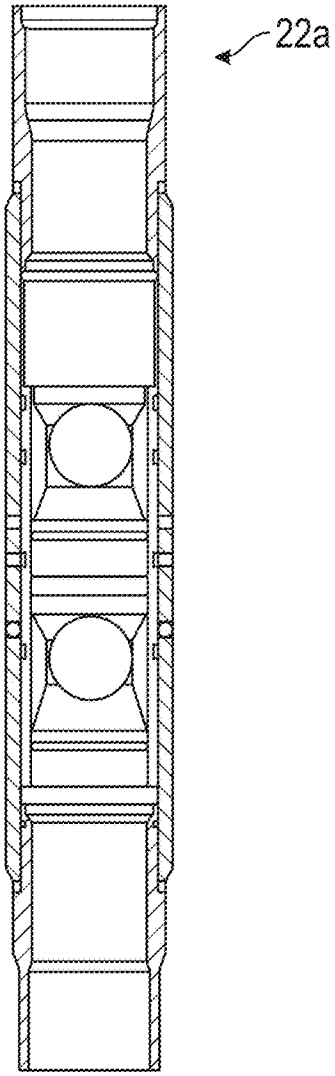
Figure 8B:
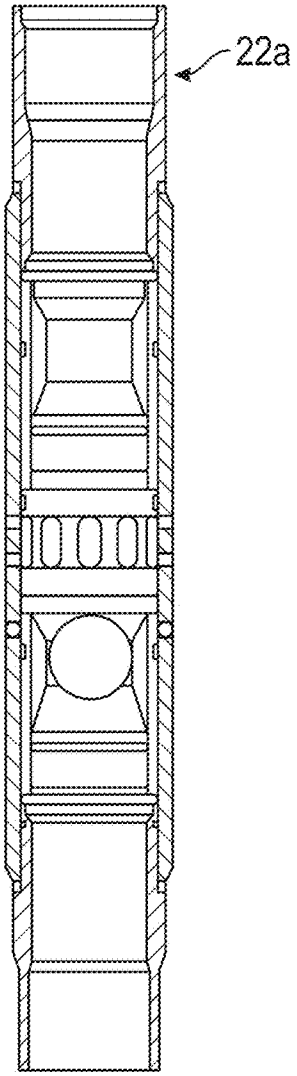
Figure 8A:
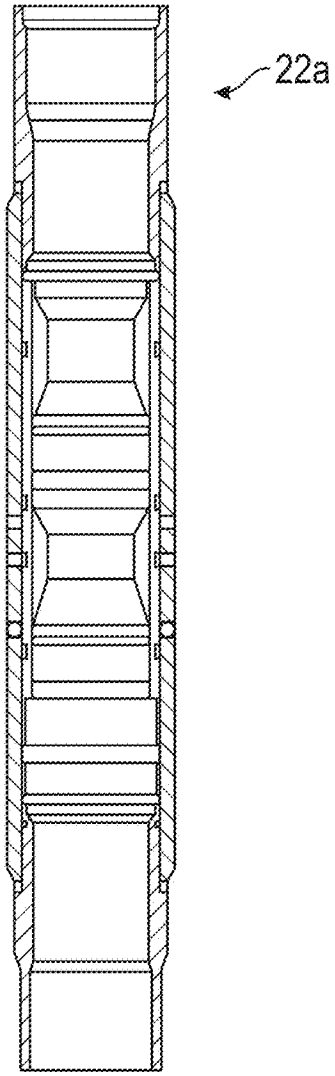
Figure 8D:
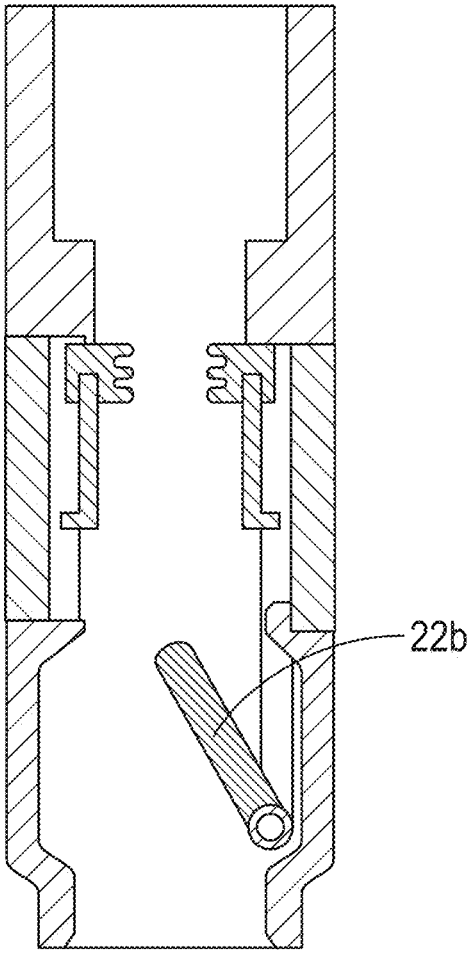

Referring now to FIGS. 8A-8D, the circulating sliding sleeve 22 of the single trip completion string 10 may include a combination of a flapper valve and dual ball seats, according to one or more embodiments of the present disclosure. Specifically, as shown in FIGS. 8A-8C, the circulating valve 22*a* of the circulating sliding sleeve 22 may include an upper sleeve ball seat and a lower sleeve ball seat, according to one or more embodiments of the present disclosure. For example, the circulating sliding sleeve 22 may be run in hole with the upper sleeve ball seat and the lower sleeve ball seat in the closed position, as shown in FIG. 8A. Then, as shown in FIG. 8B, a first ball may be dropped in the lower sleeve ball seat to open the circulating valve 22*a*. Thereafter, as shown in FIG. 8C, a second ball may be dropped in the upper sleeve ball seat to close the circulating valve 22*a*, according to one or more embodiments of the present disclosure. Moreover, as shown in FIG. 8D, the ID flapper valve 22*b* of the circulating sliding sleeve 22 may be run in hole with the ID flapper valve 22*b* in the locked open position, can then be activated closed with a trigger, and can then be locked open remotely or during well unloading. In this way, by configuring the circulating sliding sleeve 22 as a combination of a flapper valve and dual ball seats, according to one or more embodiments of the present disclosure, the circulating sliding sleeve 22 is able to operate as a remotely activated go/stop valve to facilitate gravel pack and HSCGPF pumping operations as previously described.

In other embodiments of the present disclosure, the circulating sliding sleeve 22 of the single trip completion string 10 may include a circulating valve with a dissolvable drop-off sleeve with a check valve, for example.

Advantageously, because of the discontinuous go/stop nature of the circulation sliding sleeve 22 or go/stop valve of the single trip completion string 10 according to one or more embodiments of the present disclosure, continuous pumping of treatment fluids during gravel packing and high solid content fluids pumping operations is not required, thereby eliminating the need for a service tool, which undesirably restricts the ID of the tubing and has to be retrieved.

While the circulation sliding sleeve 22 according to one or more embodiments of the present disclosure has been described as being remotely activated, in addition to remotely, the circulation sliding sleeve 22 may be activated hydraulically, mechanically, or any combination of these without departing from the scope of the present disclosure.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method of completing a well in a single trip, comprising:

drilling a wellbore with a water-based or oil-based drilling mud, the wellbore comprising: a cased hole section; and an open hole section;

running a single trip completion string into the wellbore, the single trip completion string comprising: an upper completion; a lower completion below the upper completion; and a packer disposed between the upper completion and the lower completion;

displacing a solids-free fluid out of the wellbore by pumping a fluid into the wellbore and opening or closing a circulation sliding sleeve disposed below the packer in the lower completion;

opening the circulation sliding sleeve and spotting gravel slurry in a casing annulus;

closing the circulation sliding sleeve and pumping the gravel slurry down the casing annulus into an open hole annulus while taking returns through a base pipe of a sand control assembly and production tubing of the single trip completion string;

opening the circulation sliding sleeve;

displacing the cased hole section to completion fluid;

closing the circulation sliding sleeve; and setting the packer.

2. The method of claim 1, wherein the lower completion comprises:

a wash down shoe assembly with at least one landing collar; and the sand control assembly comprising a screen disposed around the base pipe.

3. The method of claim 2, wherein the screen of the sand control assembly is one selected from the group consisting of: a wire wrap screen; a premium mesh screen;

and an alternating path screen.

4. The method of claim 2, wherein the screen of the sand control assembly comprises at least one selected from the group consisting of: a check valve; a sliding sleeve;

and a dissolvable material, film, or coating.

5. The method claim 4, wherein the sliding sleeve of the screen is activated by at least one selected from the group consisting of: hydraulically; mechanically; and remotely.

6. The method of claim 1, wherein the circulation sliding sleeve is activated by at least one selected from the group consisting of: hydraulically; mechanically; and remotely.

7. The method of claim 1, wherein the gravel slurry comprises water or oil based viscous carrier fluid.

* * * * *